United States Patent [19]

Manno

[11] 3,994,274

[45] Nov. 30, 1976

[54] COMBINATION STOVE-FIREPLACE

[76] Inventor: Joseph T. Manno, 316 Charles St., Ridgeway, Pa. 15853

[22] Filed: May 14, 1974

[21] Appl. No.: 469,861

[52] U.S. Cl. ..... 126/120; 126/4; 126/58; 126/137; 126/142

[51] Int. Cl.[2] ..... F24B 1/18

[58] Field of Search ..... 126/142, 120, 143, 123, 126/126, 136, 303, 302, 301, 121, 299, 58, 4, 307 R, 137, 65, 62; D23/95, 96, 97; 98/115 VM; 34/242; 432/260

[56] References Cited

UNITED STATES PATENTS

| | | | |
|---|---|---|---|
| 282,235 | 7/1883 | Stern | 126/301 X |
| 404,194 | 5/1889 | Holm | 126/303 |
| 661,428 | 11/1900 | Slowe | 126/303 |
| 996,554 | 6/1911 | Baldwin et al. | 98/115 |
| 2,998,967 | 9/1961 | Daily, Jr. et al. | 432/260 |
| 3,244,164 | 4/1966 | Cooper | 126/58 |

FOREIGN PATENTS OR APPLICATIONS

| | | | |
|---|---|---|---|
| 246,635 | 8/1911 | Germany | 126/307 |
| 439,281 | 12/1935 | United Kingdom | 126/143 |

*Primary Examiner*—William F. O'Dea
*Assistant Examiner*—Harold Joyce
*Attorney, Agent, or Firm*—Cushman, Darby & Cushman

[57] ABSTRACT

A combination stove-fireplace assembly. A hood with a damper therein is movable vertically from a position wherein it is spaced from the assembly base — wherein the assembly may be used as an open fireplace — to a position in sealing engagement with the base — wherein the assembly may be used as a stove or for "charcoaling". A sand-filled trench is provided at the base for insuring an air-tight seal between the base and the hood. Operating means for raising and lowering the hood include a crank exterior of the assembly positioned for ready access, and a means for locking the hood into the desired position to which it is raised. An ash bin is readily removable from underneath the firebox.

13 Claims, 4 Drawing Figures

COMBINATION STOVE-FIREPLACE

BACKGROUND AND SUMMARY OF THE INVENTION

The invention relates to fireplaces in general, and in particular to a combination stove-fireplace assembly. While it has been known to use a fireplace as a wood-burning stove (see U.S. Pat. No. 3,220,400), it has not been known to provide means for converting an open fireplace to a wood burning stove, and to provide means associated therewith for allowing "charcoaling" of a fire within the stove-fireplace. While in general movable hoods for wood and coal burning stoves have been known (see for example U.S. Pat. Nos. 439,990, 346,694 and 1,076,942) such hoods have not been known with open fireplaces, nor has the particular hood assembly according to the teachings of the present invention been known.

According to the teachings of the present invention, a base has a firebox located therein, and means associated therewith for allowing sealing engagement between the bottom of a vertically movable hood and the base. An air passage-way leads through the base to the firebox for providing air to the firebox when the hood is closed. The hood according to the teachings of the present invention is vertically movable from sealing engagement with the base — in which position the assembly may be used as a stove or for "charcoaling" — to a position spaced from the base — in which position has the assembly is used as a normal open fireplace. A damper located within a stack portion leading from the hood controls the flow of air through the firebox when the hood is in sealing engagement with the base.

The means for raising and lowering the hood comprises a crank that is easily accessible on the exterior of the assembly, which crank winds a cable attached to the hood stack portion about a pulley located within a fixed stack. Either a counter weight(s) or a means for locking the crank can be used to maintain the hood in its raised position.

A removable ash bin within the air passageway in the base, and means for supporting the fixed stack either from the ceiling or the floor may also be provided.

It is an object of the present invention to provide an open fireplace that is readily and easily convertible to a stove, and which may be adjusted for "charcoaling".

It is a further object of the present invention to provide a combination stove-fireplace having improved means for raising and lowering a hood associated therewith.

These and other objects of the invention will become clear upon an inspection of the detailed description of the invention, and from the appended claims.

DETAILED DESCRIPTION OF THE INVENTION

Figure 1:
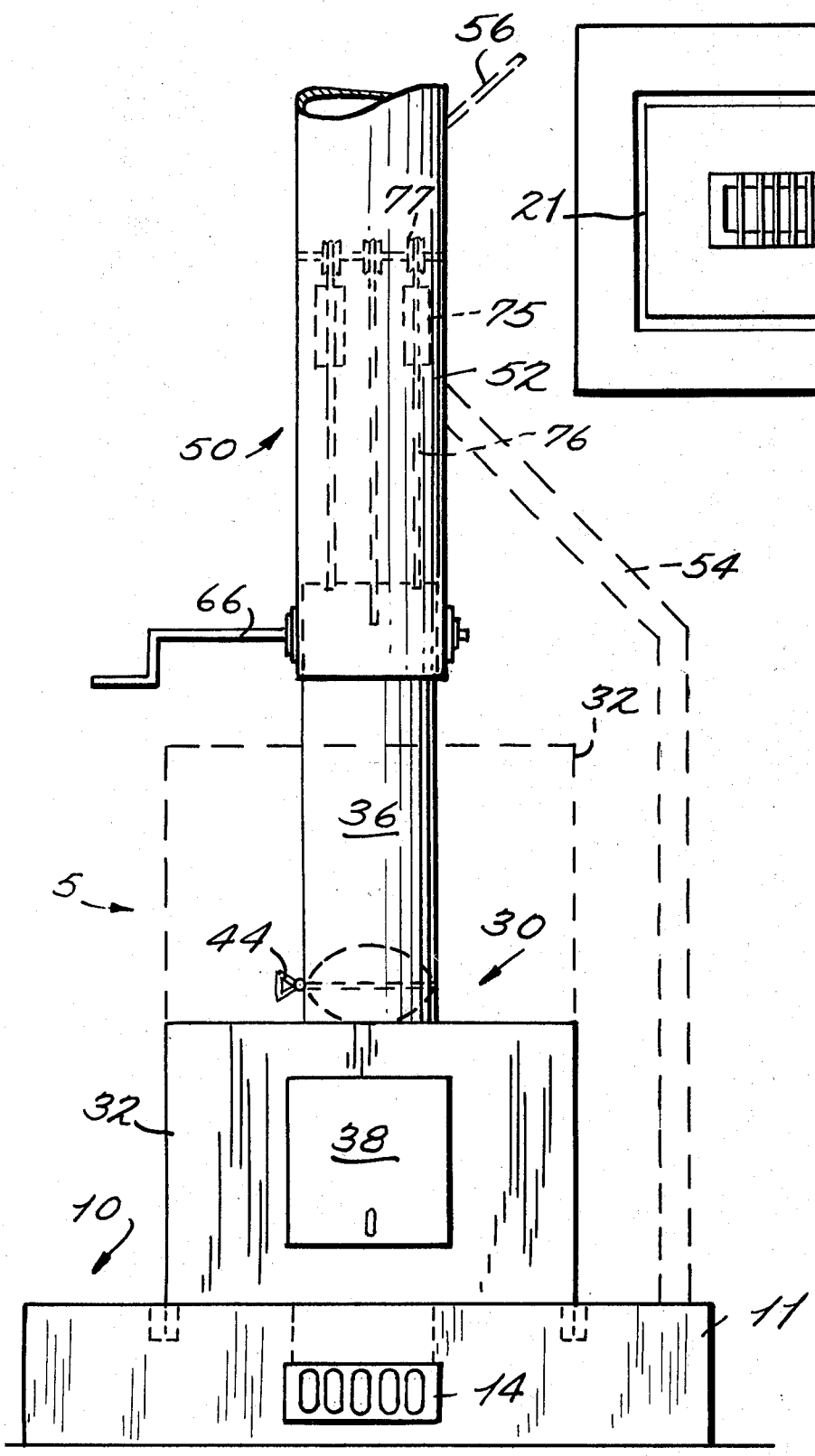
FIG. 1 is a front view of the combination stove-fireplace assembly according to the teachings of the present invention showing in solid line the hood in engagement with the base, and in dotted line the hood spaced from the base.

The combination fireplace-stove assembly according to the teachings of the present invention is shown generally at 5 in FIG. 1. The assembly is comprised of three basic components — a base means, shown generally at 10, a hood means, shown generally at 30, and a fixed stack-operating means, shown generally at 50.

The base portion 10 consists of a base 11, composed of concrete, masonry, or similar material, having an air passage-way 13 therein leading from the surroundings to a firebox, shown generally at 15, located within the base 11. The air passage-way 13 has a door 14 with openings therein located at the interface between the base 11 and the surroundings, and serves two functions. It provides for a draft of air when a fire is burning within the firebox 15 (especially when the hood means 30 is in its lowermost position), and also contains a slidable ash bin 17 therein so that ashes accumulating below the firebox 15 may be readily removed from the assembly and disposed of.

Figure 3:
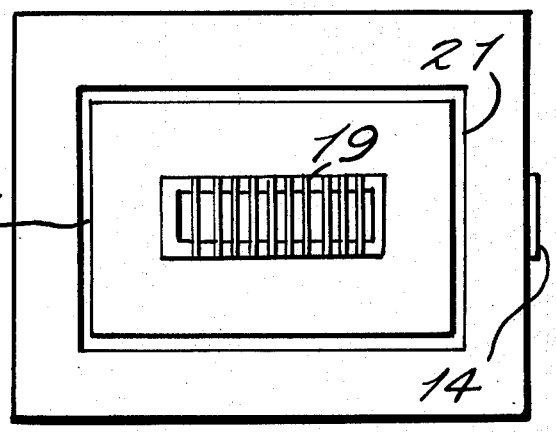
FIG. 3 is a top plan view of the base of the assembly.
Figure 2:
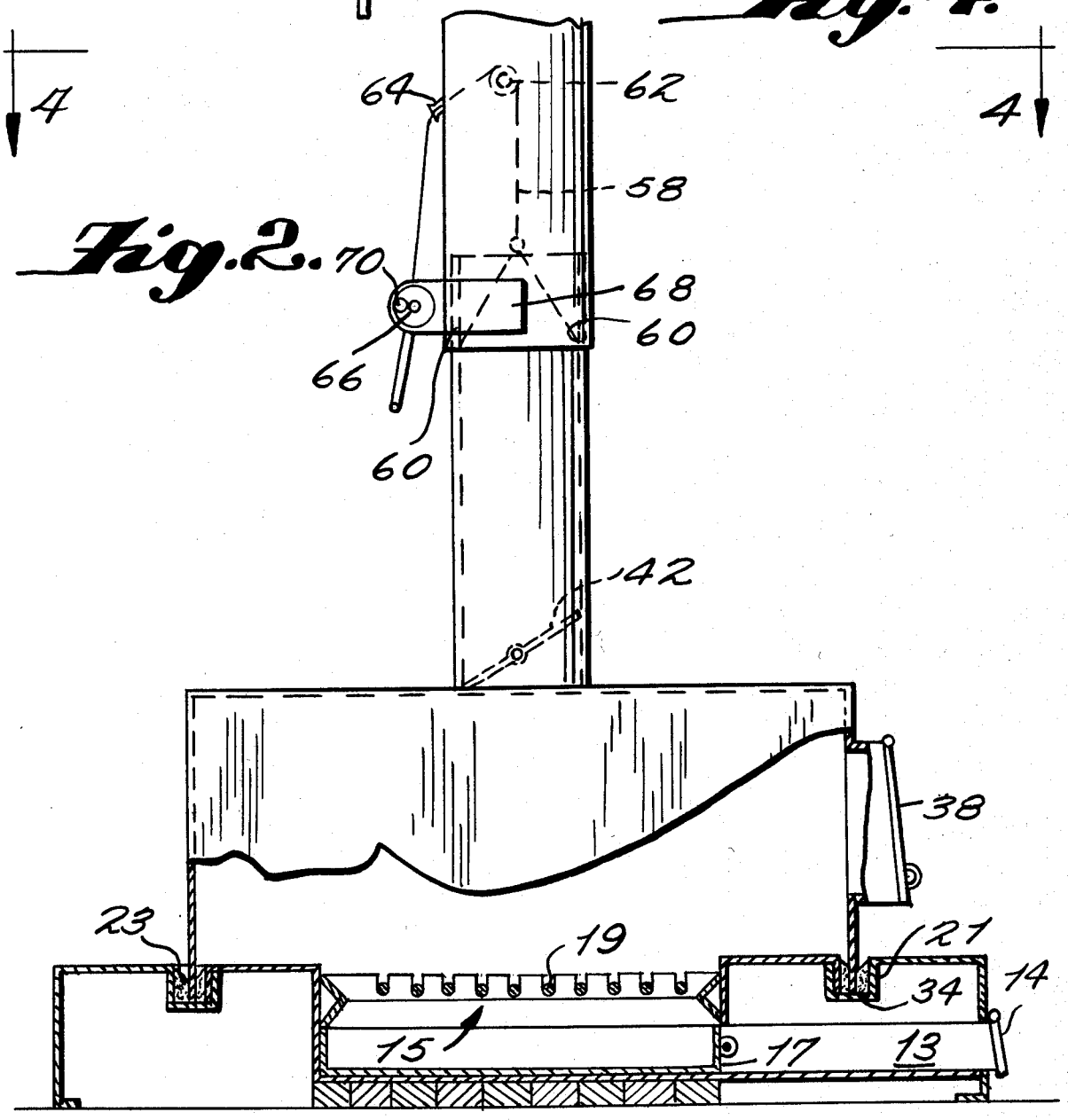
FIG. 2 is a side view partly in cross-section of the assembly according to the teachings of the present invention with the hood in engagement with the base, taken along lines 2—2 in FIG. 4.

As shown in FIGS. 2 and 3, located within the firebox 15 is a removable grill 19. While the grill 19 is shown as merely a grate in the drawings, it is to be understood that it could take any shape, and that different grills could be used depending upon whether it was desired to use the assembly as a fireplace or as a stove or for "charcoaling".

A trough or trench 21 is formed on the top face of the base 11, as shown most clearly in FIGS. 2 and 3. The trench 21 is formed to correspond to the shape of the bottom 34 of the hood means 30, which will be received by the trench 21 in one position of the hood. The trench 21 is preferably filled with sand 23 or some other material for allowing an air-tight sealing engagement between the hood means 30 and the base means 10 when the hood is received by the trench 21.

The hood means 30 includes a hood body 32, which is preferably formed of metal, which can be of any thickness or weight, and has a bottom portion 34 thereof shaped to correspond generally to the shape of the trench 21 so that it may be received thereby (as shown in FIG. 2). Extending from the top of the hood body 32 is a stack portion 36 which provides for venting of gases and smoke received by the hood body 32 from a fire burning within firebox 15. Located within the stack portion 36 is a damper 42 having a knob 44 located on the outside of the stack portion 36 for adjustment of the damper 42. The damper may be arranged so that its plane is perpendicular to the base 11, in which case gases received by the hood body 32 will be freely vented up the stack portion 36, or it may be arranged parallel to the base 11, in which case gases will pass up the stack portion 36 very slowly, and if the hood means 30 is in the position shown in FIG. 2, the draft of air from the passage-way 13 through the firebox 15 will be greatly reduced. Access to the interior of the hood body 32 is by a door 38.

The fixed stack-operating means 50 comprises a fixed stack 52 for communicating with and receiving the stack portion 36 of the hood means 30. The fixed stack 52 may be supported from the floor (or base 11) by a plurality of decorative pipe supports, such as shown in dotted line at 54 in FIG. 1, or from the ceiling by a plurality of rods or cables, such as shown in dotted line at 56 in FIG. 1, or by any other suitable means. The fixed stack will be vented to the atmosphere outside the enclosure in which the fireplace-stove assembly is located.

The means for raising and lowering the hood means 30 with respect to the fixed stack 52 includes a cable 58 rigidly attached at 60 to the interior of the stack portion 36. The cable 58 is passed around a pulley 62 rotatable about a shaft 63 located within the interior of stack 52, and then is passed outside the stack 52 through cable sleeve 64 and affixed to a crank 66 at 65. The crank 66 is rotatably supported by any suitable means, such as brackets 68 attached to the bottom portion of stack 52. By locating the handle remote from the pulley 62 and exteriorly of the whole assembly, it makes the operating means more easily accessible while allowing a longer possible path of travel of the hood means 30. Also, ready locking of the vertical position of the hood means 30 is facilitated.

Figure 4:
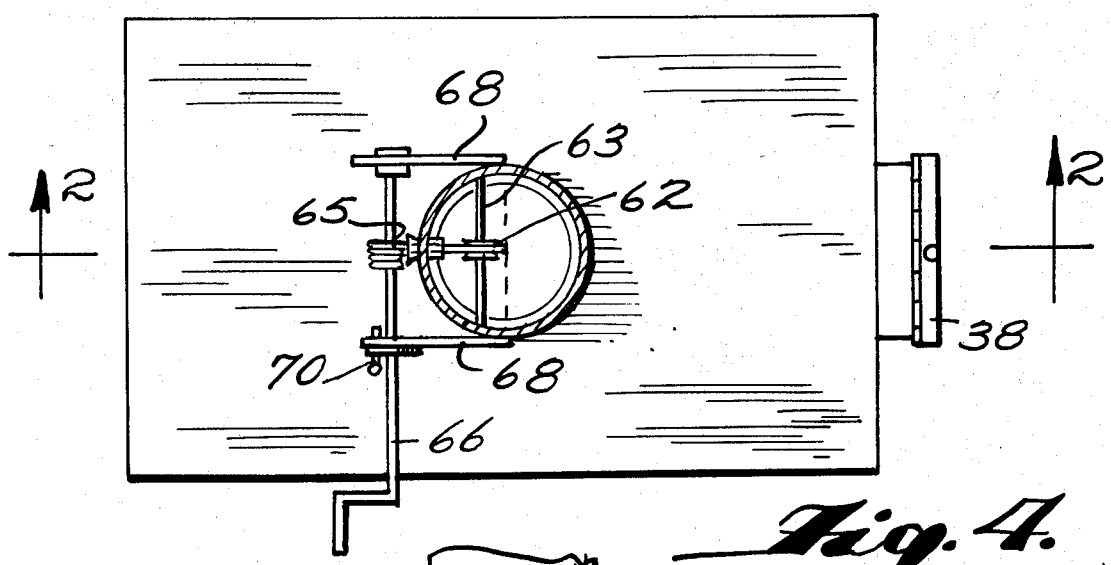
FIG. 4 is a cross-sectional view taken along lines 4—4 of FIG. 2.

The hood means 30 may be "locked" into any vertical position to which it is moved relative to base 11. In the preferred embodiment shown in FIG. 4, this is accomplished by placing a pin 70 associated with the crank 66 in an aperture in plate 68 when the desired vertical position of the hood means 30 is reached. This allows readily accessible positive latching of the position of the hood. Alternatively, as shown in dotted line in FIG. 1, a counterweight or counterweights 75 could be used. Each counterweight 75 would be attached to one end of a cable 76 passed over a pulley 77. As shown, each pulley 77 could be rotatable about shaft 63 just as operating system pulley 62 is. The cable 76 would be attached at the other end thereof to the stack portion 36. By providing weights of the proper mass, the hood means 30 could be balanced in any position to which it was raised.

When the hood means 30 is in the position shown in solid line in FIG. 1, the assembly may be used as a stove when the damper 42 is open, and any desired grill or resting means for a pan could be employed in firebox 15. The door 38 provides access to the interior of the hood body 32 so that wood or other fuel can easily be added to the firebox 15, and so that ready access to the food cooked in the stove is provided. Alternatively, when the hood means 30 is in its solid line position in FIG. 1, the damper 42 can be closed, and the unit used for "charcoaling". Since closing the damper 42 will effectively cut off the draft from passage-way 13 through the firebox 15, and since the rest of the area is sealed from the air by the engagement of bottom portion 34 of the hood body 32 and the sand 23 (or similar sealing material) in trench 21 and the air-tight closing of door 38, only a limited amount of air will be admitted to the chamber encompassed by the hood means 30, and a fire once started will "charcoal", with the loss of heat up the stack portion 32 minimized. When "charcoaling", the assembly can be used for space heating, for actually producing charcoal, or for both.

When the hood means 30 is in the dotted line position shown in FIG. 1, the assembly may be used as an attractive open-fireplace, or warmth, decoration, or both. Although the length of the path of travel of the hood means 30 is relatively large, according to the teachings of the present invention, in normal operation it is desirable that the hood means 30 not be raised so high that smoke from a fire in firebox 15 will waft into the surrounding area instead of going up the stack portion 36 and the stack 52.

It is apparent that many modifications of the present invention are possible. For instance, the hood body 32 may be covered with decorative insulating material on the exterior thereof for certain applications, or on the interior thereof for other applications. Also, the assembly and stack may be double-hooded to serve as a heating duct. Many other modifications are also possible, therefore while the invention has been disclosed in what is presently conceived to be the most preferred and practical embodiments, the invention is not to be limited to the disclosure of the details shown, but is to be accorded the full scope of the appended claims to encompass all equivalent structures and devices.

What I claim is:

1. A combination wood-burning fireplace-stove assembly comprising a. a base, b. a firebox having an open top, said firebox within said base, and having a grate disposed therein, c. hood means for collecting and venting gases from a fire within said firebox and for completely enclosing said open top of said firebox, d. a damper operatively associated with said hood means for controlling the draft of air through said assembly, e. means for raising and lowering said hood means between a first position wherein said hood means is in air-tight sealing engagement with said base and completely encloses said open top of said firebox, and a second position wherein said hood means is spaced from said base leaving open said top of said firebox but still collecting gases from a fire within said firebox, so that in said first position of said hood means said assembly may function as a stove or may be used for charcoaling, and so that in said second position of said hood means said assembly may function as a fireplace, and f. a door provided in said hood means for allowing access to said firebox when said hood means is in said first position.

2. An assembly as recited in claim 1 wherein an air passage is provided through said base to said firebox for providing air to said firebox especially when said hood means is in said first position thereof.

3. An assembly as recited in claim 2 wherein said assembly further comprises a removable ash bin slidable within said air passage for removing ashes from the vicinity of said firebox.

4. An assenbly as recited in claim 1 wherein means for providing air-tight sealing engagement between said hood means and said base includes a trench in said base formed to receive a bottom perimeter of said hood means.

5. An assembly as recited in claim 4 wherein said trench is filled with sand.

6. An assembly as recited in claim 1 wherein said hood means has a stack portion extending from said hood means away from said firebox, said damper being located with said stack portion.

7. An assembly as recited in claim 6 wherein said means for raising and lowering said hood means between said first and second positions thereof includes a fixed stack for receiving said stack portion of said hood means and a cable attached to said stack portion, said cable generally disposed within said stack.

8. An assembly as recited in claim 7 wherein said raising and lowering means further comprises a pulley rotatable about a shaft, said cable being in operative engagement with said pulley, a crank to which said cable is operatively attached, said crank being rotatable about an axis spaced from said shaft of said pulley and said crank being located completely exteriorly of said stack, and means for maintaining said hood means in said second position thereof.

9. An assembly as recited in claim 8 wherein said means for maintaining said hood means in said second position thereof is a means for locking said crank in its position thereof corresponding to said second position of said hood means.

10. An assembly as recited in claim 8 wherein said means for maintaining said hood means in said second position thereof is at least one counterweight attached by a cable to said stack portion of said hood means, said cable in operative engagement with a pulley contained within said stack.

11. An assembly as recited in claim 7 wherein said assembly further includes means for supporting said fixed stack from the ceiling of a building in which said assembly is located.

12. An assembly as recited in claim 7 wherein said assembly further includes means for supporting said fixed stack from the floor of a building in which said assembly is located.

13. An assembly as recited in claim 12 wherein said supporting means includes a plurality of decorative poles running from said base to said fixed stack.

* * * * *